United States Patent [19]

Bertelsen

[11] Patent Number: 4,563,943

[45] Date of Patent: Jan. 14, 1986

[54] FILTER APPARATUS FOR HIGH SPEED PRINTERS

[76] Inventor: John C. Bertelsen, 3060 Baker Rd., Dexter, Mich. 48130

[21] Appl. No.: 708,649

[22] Filed: Mar. 6, 1985

Related U.S. Application Data

[63] Continuation-in-part of Ser. No. 443,122, Nov. 19, 1982, abandoned.

[51] Int. Cl.[4] ..... F23J 11/00

[52] U.S. Cl. ..... 98/115.1; 55/419; 55/472; 98/115.4; 355/3 R

[58] Field of Search ..... 55/316, 419, 472; 98/42.06, 115.1, 115.4; 355/3 R

[56] References Cited

U.S. PATENT DOCUMENTS

| | | | |
|---|---|---|---|
| 2,710,574 | 6/1955 | Runion | 98/115.1 |
| 3,381,453 | 5/1968 | Dills | 98/115.1 X |
| 3,999,911 | 12/1976 | Matsubara | 98/115.1 X |
| 4,038,913 | 8/1977 | Earley | 98/115.1 |
| 4,163,650 | 8/1979 | Watson et al. | 98/115.1 X |
| 4,178,092 | 12/1979 | Yamamoto et al. | 98/115.1 X |

FOREIGN PATENT DOCUMENTS

| | | | |
|---|---|---|---|
| 770219 | 3/1957 | United Kingdom | 98/115.1 |

*Primary Examiner*—Harold Joyce

*Attorney, Agent, or Firm*—Charles W. Chandler

[57] ABSTRACT

A filter system for removing air borne contaminants such as carbon black discharged from high speed printers such as page printers, laser printers, and the like.

3 Claims, 7 Drawing Figures

14
16
10
12
42
38
26
28
30
32
34
36
58
18
22
24

3
50
52
54
56
3

308
310
302
300
10
16
306
314
55B
304
312
55A 10
16
14
42
12
57
54
59
38
34
36
32
56
58
24

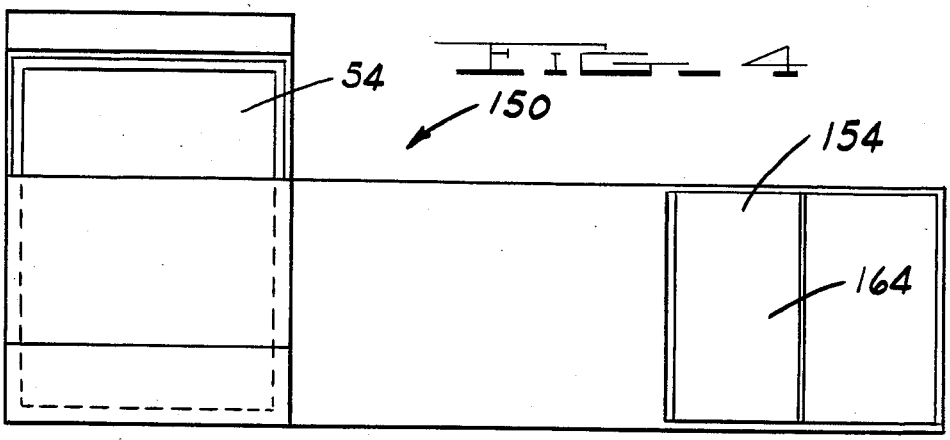
FIG. 4
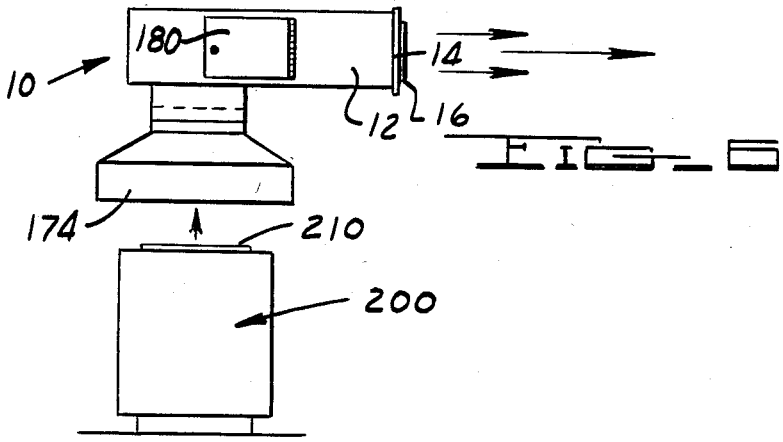
FIG. 5
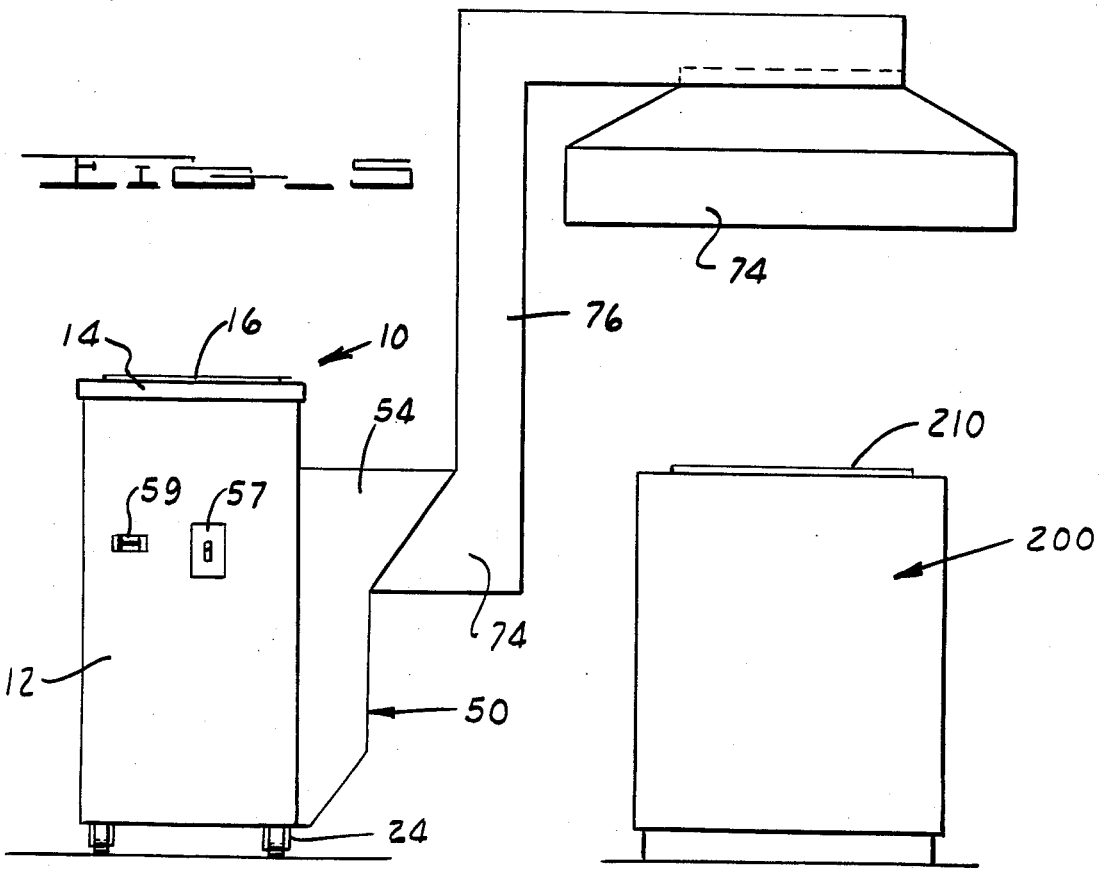

FILTER APPARATUS FOR HIGH SPEED PRINTERS

CROSS-REFERENCE TO RELATED APPLICATION

This application is a Continuation-in-part of application Ser. No. 443,122, filed Nov. 19, 1982, now abandoned, for Exhaust System for Paper Handling Machines.

BACKGROUND OF THE INVENTION

Laser and other such high speed printers have produced a problem unlike any similar printing machine because of the massive volume of paper that is processed through the printer as well as the high speed printing techniques employed.

One of the reasons is that carbon black, a dry product used in such printers, has unique properties that make it extremely difficult to remove either from the air or any surface to which it sticks. In addition, it has properties that make it very destructive toward other sensitive computer equipment in the computer room.

As is well known, computer rooms generally have a controlled temperature and humidity, and employ air conditioning equipment within the room rather than a central air conditioning unit for delivering outside air into the room. Room air conditioners are not suitable for removing carbon black from the air because this material plugs up the air conditioning and defeats its air conditioning function.

Removing the printer from the computer room does not solve the problem of removing contaminants from the air in the vicinity of the printer.

In addition, the airborne materials provide a serious health problem for the personnel operating the printing equipment. Toner chemicals and developer are discharged into the air around the high speed equipment which have been identified as being potentially harmful and health-impairing when inhaled over long periods of time, while carbon black is discharged from other printers in sufficient quantities to pose a health problem.

SUMMARY OF THE INVENTION

The prupose of the present invention is to remove and detoxify airborne particulate and chemical fumes discharged from high speed printers in a computer room having conditioned air without interfering with the normal air flow through the printer. The preferred filter apparatus removes carbon black and other contaminants from the discharge outlet of a laser printer, employing a plurality of mechanical screening devices of differing materials, some of which are rechargeable to provide longer equipment life, while at the same time eliminating a number of potentially serious health problems.

Still further objects and advantages of the invention will become readily apparent to those skilled in the art to which the invention pertains upon reference to the following detailed description.

DESCRIPTION OF THE DRAWINGS

FIG. 4 illustrates a modified form of the front cover structure shown in FIG. 2;

FIG. 5 illustrates still another modified form of the invention;

FIG. 6 shows another modified form of the invention; and

DESCRIPTION OF THE PREFERRED EMBODIMENT

Figure 1:
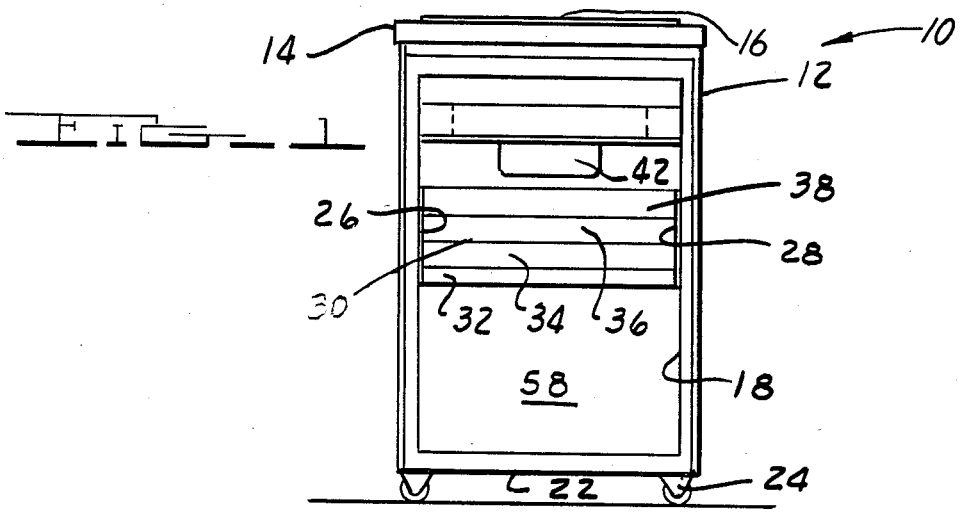
FIG. 1 illustrates a front elevational view of a preferred embodiment of the invention in an air conditioned computer room with the front cover removed.

FIG. 1 of the drawings illustrate filter device 10 in an air conditioned computer room, with the hood removed. This exposes the internal components mounted in rectangular housing 12. Top cover 14 has a clean air outlet opening 16.

The front portion of housing 12 has a rectangular flanged lower opening 18 and a bottom 22 on which wheels 24 are mounted to make the structure mobile. Wheels 24 are pivotal, thus making the filter device 10 unidirectional. The central section of housing 12 has screening pack assembly 30, removably supported within the housing by left positioning means 26 and right positioning means 28.

Screening pack assembly 30 comprises four screening members. A coarse fiberglass screen pack 32 is positioned at the bottom and is designed to remove particulate up to the 10 micron range. A second and more dense fiber glass or similar material screen 34 is positioned adjacent to screen 32. The second screen is designed to remove particulate up to the 3 to 5 micron size. A third screen 36 is made up with carbonized and activated charcoal, which functions to remove odors and also to detoxify any other materials passing therethrough. A fourth screening member 38 is made from synthetic purafil and functions to also remove odors, and particulate in the 0.01 micron size range.

Electronically powered fan 42 is positioned immediately above screen pack 30 to draw air upwardly through the screening members to remove the carbon black and paper dust. The filtered air is discharged through opening 16.

Figure 2:
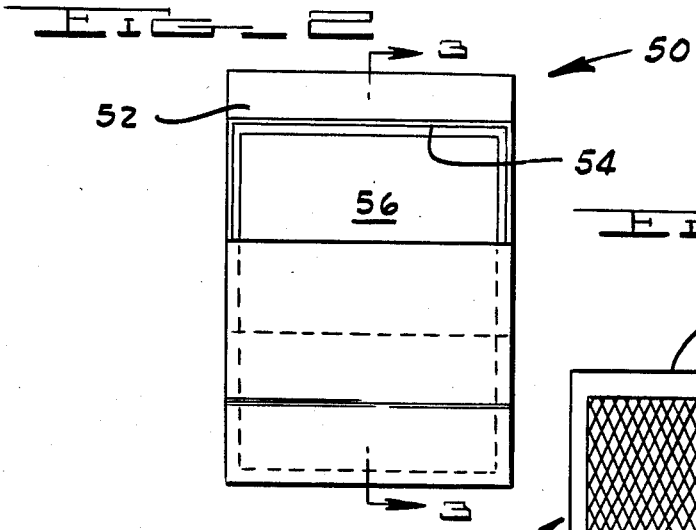
FIG. 2 shows one form of a front cover and contaminated air inlet.

FIG. 2 illustrates removable hood 50. Hood 50 has a generally rectangular configuration and is slightly larger than flanged opening 18 in housing 12. Suitable means for attachment of the hood to the housing might include any type fastener such as screws. The hood may be suspended by means of flanged members extending from housing member 12, which cooperate with keyhole slots in cover 52, or such other means which will do the job.

Figure 3:
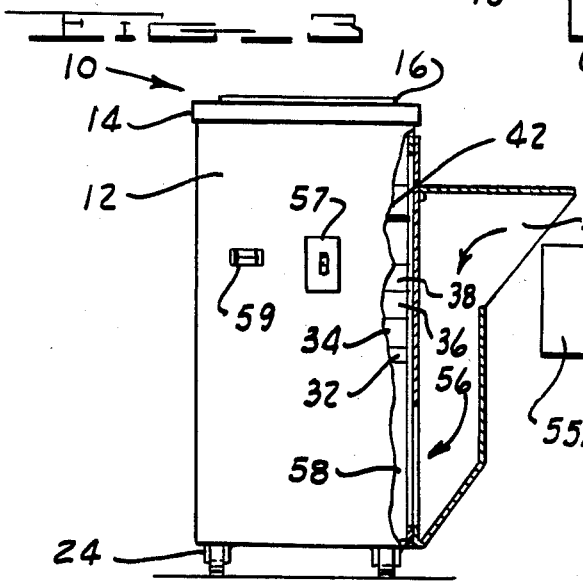
FIG. 3 is a fragmentary view generally as seen along lines 3—3 of FIG. 2.

FIG. 3 illustrates housing 12 with the right edge broken away. Hood 50 has air inlet 54 mounted closely adjacent but spaced with respect to discharge opening 55A of laser printer 55B. The air flow path 56 is determined by the hood configuration. Switch 57 is mounted on the side of the housing for operating fan 42, along with a fan speed control 59.

FIG. 4 illustrates a modified form of hood 150 which has an extension of the duct work attached thereto to provide an additional air intake opening 154, with a baffle member 164 disposed therein for improved air intake control. The ductwork extension is designed to be positioned adjacent to an exhaust outlet from a high speed printer. Air inlet 154 is substantially the same as the structure described in connection with FIGS. 2 and 3, respectively.

FIG. 5 illustrates a modified form of the invention, wherein high speed laser printer 200 discharges contaminated air through opening 210 into overhead hood 74 connected by duct 76 to air inlet 54 in the filter device 10. Printer 200 could also be either a burster or a decollator.

In FIG. 6, a similar type structure is shown, wherein filter device 10 is ceiling mounted. An overhead hood 174 is attached to air inlet 54 in filter device 10 which receives the contaminated air being discharged from opening 210 of high speed printer 200. A hinged door 180 in the side of housing 12 permits access to the screening members for recharging, service or replacement.

Figure 7:
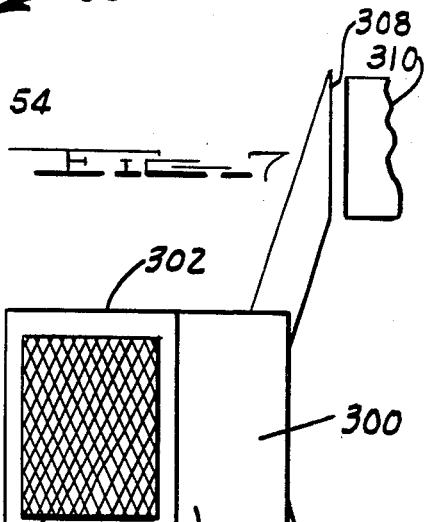
FIG. 7 shows the invention with a multi-inlet cover.

Referring to FIG. 7, a plan view of filter device 10 is illustrated with hood 300 having a pair of lateral ducts 302 and 304 extending in different directions from hood 306. Duct 302 has an inlet opening 308 for receiving the air discharged from an laser printer discharge duct 310 while duct 304 has an opening 312 for receiving the air discharged from the outlet opening of a second laser printer 314. The air from both printers 310 and 314 are received into filter device 10 and then filtered and discharged through outlet opening 16. The embodiment of FIG. 7 is particularly useful for two or more laser printers. The two receiving ducts can be disposed at any appropriate angle or height depending upon the location of the outlet openings of the printers.

From the foregoing description, it is apparent that the proposed invention provides a solution for a problem confronting the high speed printing industry, in a unique and efficient manner.

Having described my invention, I claim:

1. In a computer printing room, the combination comprising:

a printer housing having an outlet opening;

high speed laser or the like printing means in the printer housing providing a source of airborne carbon black particles employed in the printing process and disposed to pass through the outlet opening;

a filter housing having an inlet opening, and an outlet opening, the filter housing being spaced from the printer housing;

a plurality of filter means suited for removing airborne paper dust, carbon black and the like, removably mounted in the filter housing between the inlet opening and the outlet opening;

fan means mounted in the filter housing for moving air carrying such airborne particles into the inlet opening, through the filter means, and out the outlet opening;

a duct having an outlet opening, and means attaching the duct to the filter housing such that the duct outlet opening is adjacent the filter housing inlet opening; and a hood mounted on the duct to define a hood inlet opening remote from the filter housing inlet opening and horizontally spaced therefrom, the hood inlet opening being disposed closely adjacent and aligned with the outlet opening of the printer housing, but not being attached thereto, to receive airborne particles from the printer housing outlet opening and to pass such airborne particles through the duct and said filter means such that the airborne particles are removed by the filter means, and the filtered air passes from the filter housing outlet opening into said computer printing room.

2. A combination as in claim 1 wherein one of the plurality of filter means contains activated charcoal which functions to absorb and detoxify any toner, developer and other harmful chemicals which are passed therethrough.

3. A combination as in claim 1 wherein at least one of said plurality of filter means is rechargeable.

* * * * *